US011741872B2

(12) United States Patent
Tao et al.

(10) Patent No.: US 11,741,872 B2
(45) Date of Patent: Aug. 29, 2023

(54) GOA CIRCUIT AND DISPLAY PANEL

(71) Applicant: WUHAN CHINA STAR OPTOELECTRONICS TECHNOLOGY CO., LTD., Hubei (CN)

(72) Inventors: Jian Tao, Hubei (CN); Yue Wang, Hubei (CN); Yafeng Li, Hubei (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 422 days.

(21) Appl. No.: 17/046,835

(22) PCT Filed: Jun. 23, 2020

(86) PCT No.: PCT/CN2020/097743
§ 371 (c)(1),
(2) Date: Oct. 12, 2020

(87) PCT Pub. No.: WO2021/223303
PCT Pub. Date: Nov. 11, 2021

(65) Prior Publication Data

US 2023/0103641 A1 Apr. 6, 2023

(30) Foreign Application Priority Data

May 8, 2020 (CN) ..... 202010379891.1

(51) Int. Cl.
*G09G 3/20* (2006.01)

(52) U.S. Cl.
CPC ..... *G09G 3/20* (2013.01); *G09G 2300/0408* (2013.01); *G09G 2300/0426* (2013.01); *G09G 2310/0267* (2013.01); *G09G 2310/08* (2013.01)

(58) Field of Classification Search
CPC ..... G09G 3/3677; G09G 2310/0286; G09G 2310/08
See application file for complete search history.

(56) References Cited

U.S. PATENT DOCUMENTS

| | | | | |
|---|---|---|---|---|
| 10,714,044 | B1 * | 7/2020 | Zhang | G09G 3/3677 |
| 10,977,979 | B1 * | 4/2021 | Xiao | G09G 3/20 |
| 2008/0012818 | A1 | 1/2008 | Lee et al. | |
| 2017/0102801 | A1 | 4/2017 | Ko et al. | |

(Continued)

FOREIGN PATENT DOCUMENTS

| | | | |
|---|---|---|---|
| CN | 105355179 | A | 2/2016 |
| CN | 105355235 | A | 2/2016 |

(Continued)

*Primary Examiner* — Van N Chow
(74) *Attorney, Agent, or Firm* — Soroker Agmon Nordman Riba

(57) ABSTRACT

A GOA circuit and a display panel are provided. The GOA circuit includes a first pull-down module for pulling down a voltage level of a current-stage gate driving signal, a second pull-down module for pulling down a voltage level of the first node, a third pull-down module for pulling down a voltage level of the second node, and a fourth pull-down module for pulling down the voltage level of the current-stage gate driving signal. The GOA circuit raises the effect of pulling down the current-stage gate driving signal.

14 Claims, 4 Drawing Sheets

(56) References Cited

U.S. PATENT DOCUMENTS

| | | | | |
|---|---|---|---|---|
| 2019/0311690 | A1* | 10/2019 | Chen | G06F 3/0416 |
| 2020/0035181 | A1* | 1/2020 | Zhang | G09G 3/3677 |
| 2020/0082746 | A1* | 3/2020 | Zhang | G09G 3/3677 |
| 2020/0320949 | A1 | 10/2020 | Li et al. | |
| 2022/0051598 | A1* | 2/2022 | Xue | G09G 3/20 |

FOREIGN PATENT DOCUMENTS

| | | | |
|---|---|---|---|
| CN | 107863074 | A | 3/2018 |
| CN | 108766380 | A | 11/2018 |
| CN | 111179871 | A | 5/2020 |

* cited by examiner

GOA CIRCUIT AND DISPLAY PANEL

FIELD OF THE INVENTION

The present invention relates to a display technique, and more particularly, to a GOA circuit and a display panel.

BACKGROUND

The $n^{th}$-stage gate driver on array (GOA) unit of the conventional GOA circuit is shown in FIG. 1. The GOA unit comprises a forward/backward scan control module 101, a node signal control module 102, an output control module 103, a pull-up module 104, a first pull-down module 105, a second pull-down module 107, a third pull-down module 108, a fourth pull-down module 109, a regulating module 110, a first capacitor C1 and a second capacitor C2. Each module comprises one or more transistors and the connections of the transistors are shown in FIG. 1. The GOA unit could provide a gate driving signal Gate_N to the current-stage ($n^{th}$-stage) scan lines.

When the conventional GOA unit receives the falling edge of the clock signal CKN, the conventional GOA unit is not able to quickly pull down the voltage level of the output signal of the output control module 103 to a low voltage level. This makes the fall time of the current-stage gate driving signal Gate_N too long. This means that when the transistors of the previous line have not been turned off, the data starts to be written to the next line and thus introduces interferences. Furthermore, in the display panel, the scan lines and the data lines cross each other and coupling capacitors exist between the scan lines and the data lines. Because multiple data lines are above one scan line and cross the scan line and the signals in the data lines may have multiple transitions between the high voltage level and the low voltage level, this may introduce huge coupling effect. This means that the coupling capacitor may pull up the gate driving signal from a low voltage level and thus generates some noises.

Thus, the conventional display panel may have a technical issue of ineffectively pulling down the gate driving signal and needs to be improved.

SUMMARY

One objective of an embodiment of the present invention is to provide a GOA circuit and a display panel to alleviate the above-mentioned issue of ineffectively pulling down the gate driving signal in the conventional display panel.

According to an embodiment of the present invention, a gate driver on array (GOA) circuit is disclosed. The GOA circuit comprises m cascaded GOA units. The $n^{th}$-stage GOA unit comprises: a scan control module, configured to pull up a voltage level of a first node according to a $(n-1)^{th}$-stage clock signal and a $(n+1)^{th}$-stage clock signal to control the GOA circuit to perform a scanning operation; an output control module, electrically connected to the scan control module through the first node, configured to output a high-voltage-level current-stage gate driving signal according to a high-voltage-level current-stage clock signal or output a low-voltage-level current-stage gate driving signal according to a low-voltage-level current-stage clock signal when the first node corresponds to a high voltage level; a node control module, configured to pull up a voltage level of a second node according to a reset signal and a $(n+2)^{th}$-stage clock signal; a first pull-down module, electrically connected to the node control module through the second node, configured to pull down a voltage level of a current-stage gate driving signal according to a low voltage signal when the second node corresponds to a high voltage level; a second pull-down module, electrically connected to the node control module through the second node, configured to pull down a voltage level of the first node according to the low voltage signal when the second node corresponds to a high voltage level; a third pull-down module, electrically connected to the scan control module through the first node, configured to pull down a voltage level of the second node according to the low voltage signal when the first node corresponds to a high voltage level; and a fourth pull-down module, configured to control the GOA circuit to pull down the voltage level of the current-stage gate driving signal according to the global signal.

In the GOA circuit of the present invention, the scan control module comprises: a first transistor, having a gate connected to a gate driving signal of a $(n-1)^{th}$-stage GOA unit, a first electrode connected to a high voltage signal, and a second electrode connected to the first node; and a second transistor, having a gate connected to a gate driving signal of a $(n+1)^{th}$-stage GOA unit, a first electrode connected to the high voltage signal, and a second electrode connected to the first node.

In the GOA circuit of the present invention, the output control module comprises: a third transistor, having a first electrode connected to the current-stage clock signal and a second electrode connected to the current-stage gate driving signal.

In the GOA circuit of the present invention, the node control module comprises: a fourth transistor, having a gate connected to the reset signal, a first electrode connected to the gate of the fourth transistor, and a second electrode; and a fifth transistor, having a gate connected to the $(n+2)^{th}$-stage clock signal, a first electrode connected to the gate of the fifth transistor, and a second electrode connected to the second node and the second electrode of the fourth transistor.

In the GOA circuit of the present invention, the first pull-down module comprises: a sixth transistor, having a gate connected to the second node, a first electrode connected to the low voltage signal, and a second electrode connected to the current-stage gate driving signal.

In the GOA circuit of the present invention, the second pull-down module comprises: a seventh transistor, having a gate connected to the second node, a first electrode connected to the low voltage signal, and a second electrode connected to the first node.

In the GOA circuit of the present invention, the third pull-down module comprises: an eighth transistor, having a gate connected to the first node, a first electrode connected to the low voltage signal, a second electrode connected to the second node.

In the GOA circuit of the present invention, the fourth pull-down module comprises: a ninth transistor, having a gate connected to the global signal, a first electrode connected to the low voltage signal, and a second electrode connected to the current-stage gate driving signal.

In the GOA circuit of the present invention, the $n^{th}$-stage GOA unit further comprises: a regulating module, comprising: a tenth transistor, having a gate connected to the high voltage signal, a first electrode connected to the first node, and a second electrode connected to the gate of the third transistor through a third node.

In the GOA circuit of the present invention, the $n^{th}$-stage GOA unit further comprises: a capacitor, having a first electrode plate connected to the second node, and a second electrode plate connected to the low voltage signal.

According to an embodiment of the present invention, a display panel is disclosed. The display panel comprises a GOA circuit. The GOA circuit comprises m cascaded GOA units. The $n^{th}$-stage GOA unit comprises: a scan control module, configured to pull up a voltage level of a first node according to a $(n-1)^{th}$-stage clock signal and a $(n+1)^{th}$-stage clock signal to control the GOA circuit to perform a scanning operation; an output control module, electrically connected to the scan control module through the first node, configured to output a high-voltage-level current-stage gate driving signal according to a high-voltage-level current-stage clock signal or output a low-voltage-level current-stage gate driving signal according to a low-voltage-level current-stage clock signal when the first node corresponds to a high voltage level; a node control module, configured to pull up a voltage level of a second node according to a reset signal and a $(n+2)^{th}$-stage clock signal; a first pull-down module, electrically connected to the node control module through the second node, configured to pull down a voltage level of a current-stage gate driving signal according to a low voltage signal when the second node corresponds to a high voltage level; a second pull-down module, electrically connected to the node control module through the second node, configured to pull down a voltage level of the first node according to the low voltage signal when the second node corresponds to a high voltage level; a third pull-down module, electrically connected to the scan control module through the first node, configured to pull down a voltage level of the second node according to the low voltage signal when the first node corresponds to a high voltage level; and a fourth pull-down module, configured to control the GOA circuit to pull down the voltage level of the current-stage gate driving signal according to the global signal.

In the display panel of the present invention, the scan control module comprises: a first transistor, having a gate connected to a gate driving signal of a $(n-1)^{th}$-stage GOA unit, a first electrode connected to a high voltage signal, and a second electrode connected to the first node; and a second transistor, having a gate connected to a gate driving signal of a $(n+1)^{th}$-stage GOA unit, a first electrode connected to the high voltage signal, and a second electrode connected to the first node.

In the display panel of the present invention, the output control module comprises: a third transistor, having a first electrode connected to the current-stage clock signal and a second electrode connected to the current-stage gate driving signal.

In the display panel of the present invention, the node control module comprises: a fourth transistor, having a gate connected to the reset signal, a first electrode connected to the gate of the fourth transistor, and a second electrode; and a fifth transistor, having a gate connected to the $(n+2)^{th}$-stage clock signal, a first electrode connected to the gate of the fifth transistor, and a second electrode connected to the second node and the second electrode of the fourth transistor.

In the display panel of the present invention, the first pull-down module comprises: a sixth transistor, having a gate connected to the second node, a first electrode connected to the low voltage signal, and a second electrode connected to the current-stage gate driving signal.

In the display panel of the present invention, the second pull-down module comprises: a seventh transistor, having a gate connected to the second node, a first electrode connected to the low voltage signal, and a second electrode connected to the first node.

In the display panel of the present invention, the third pull-down module comprises: an eighth transistor, having a gate connected to the first node, a first electrode connected to the low voltage signal, a second electrode connected to the second node.

In the display panel of the present invention, the fourth pull-down module comprises: a ninth transistor, having a gate connected to the global signal, a first electrode connected to the low voltage signal, and a second electrode connected to the current-stage gate driving signal.

In the display panel of the present invention, the $n^{th}$-stage GOA unit further comprises: a regulating module, comprising: a tenth transistor, having a gate connected to the high voltage signal, a first electrode connected to the first node, and a second electrode connected to the gate of the third transistor through a third node.

In the display panel of the present invention, the $n^{th}$-stage GOA unit further comprises: a capacitor, having a first electrode plate connected to the second node, and a second electrode plate connected to the low voltage signal.

The present invention provides a GOA circuit and a display panel. The GOA circuit comprises m cascaded GOA units. The $n^{th}$-stage GOA unit comprises: a scan control module, configured to pull up a voltage level of a first node according to a $(n-1)^{th}$-stage clock signal and a $(n+1)^{th}$-stage clock signal to control the GOA circuit to perform a scanning operation; an output control module, electrically connected to the scan control module through the first node, configured to output a high-voltage-level current-stage gate driving signal according to a high-voltage-level current-stage clock signal or output a low-voltage-level current-stage gate driving signal according to a low-voltage-level current-stage clock signal when the first node corresponds to a high voltage level; a node control module, configured to pull up a voltage level of a second node according to a reset signal and a $(n+2)^{th}$-stage clock signal; a first pull-down module, electrically connected to the node control module through the second node, configured to pull down a voltage level of a current-stage gate driving signal according to a low voltage signal when the second node corresponds to a high voltage level; a second pull-down module, electrically connected to the node control module through the second node, configured to pull down a voltage level of the first node according to the low voltage signal when the second node corresponds to a high voltage level; a third pull-down module, electrically connected to the scan control module through the first node, configured to pull down a voltage level of the second node according to the low voltage signal when the first node corresponds to a high voltage level; and a fourth pull-down module, configured to control the GOA circuit to pull down the voltage level of the current-stage gate driving signal according to the global signal. The present invention does not place a capacitor at the first node. Therefore, when the first node and the current-stage clock signal both correspond to a low voltage level, the voltage level of the current-stage gate driving signal could be quickly pulled down such that the fall time of the current-stage gate driving signal is reduced and the interference is alleviated. After the voltage level of the current-stage gate driving signal is changed from the high voltage level to the low voltage level, the node control module pulls up the voltage level of the second node. In this way, the first pull-down module and the second pull-down module work together to pull down the current-stage gate driving signal through the low voltage signal. This could help alleviate other signals' pulling up the current-stage gate driving signal and thus reduces the noises. Therefore, the GOA circuit of an embodiment of the present invention raises the effect of pulling down the current-stage gate driving signal.

BRIEF DESCRIPTION OF THE DRAWINGS

To describe the technical solutions in the embodiments of this application more clearly, the following briefly introduces the accompanying drawings required for describing the embodiments. Apparently, the accompanying drawings in the following description show merely some embodiments of this application, and a person of ordinary skill in the art may still derive other drawings from these accompanying drawings without creative efforts.

DETAILED DESCRIPTION OF PREFERRED EMBODIMENTS

Figure 1:
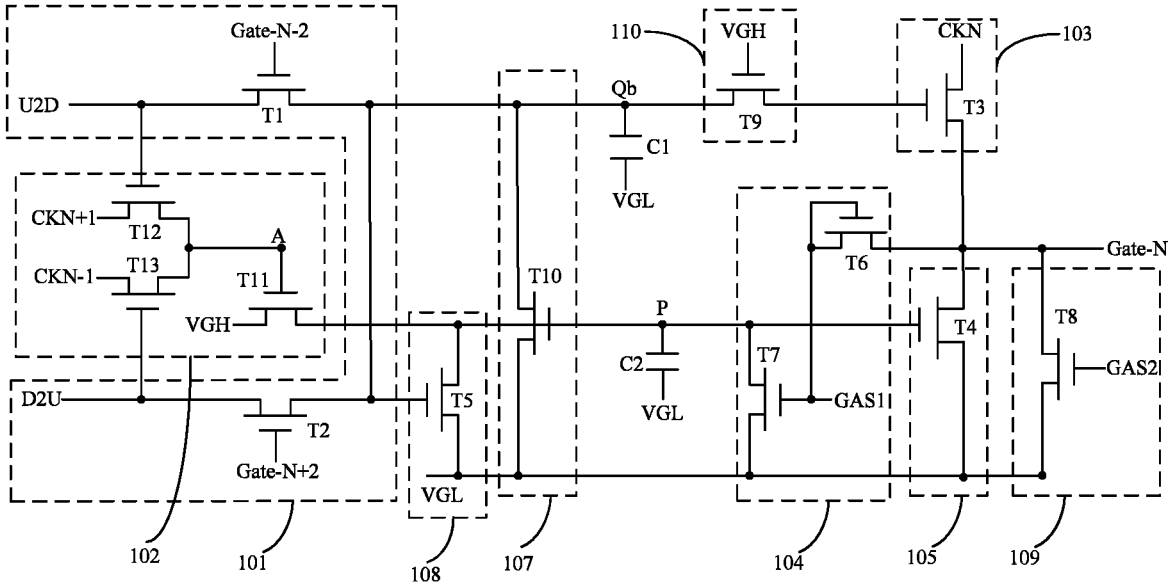
FIG. 1 is a diagram of a conventional GOA circuit.

To help a person skilled in the art better understand the solutions of the present disclosure, the following clearly and completely describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present disclosure.

It is understood that terminologies, such as "center," "longitudinal," "horizontal," "length," "width," "thickness," "upper," "lower," "before," "after," "left," "right," "vertical," "horizontal," "top," "bottom," "inner," "outer," "clockwise," and "counterclockwise," are locations and positions regarding the figures. These terms merely facilitate and simplify descriptions of the embodiments instead of indicating or implying the device or components to be arranged on specified locations, to have specific positional structures and operations. These terms shall not be construed in an ideal or excessively formal meaning unless it is clearly defined in the present specification. In addition, the term "first", "second" are for illustrative purposes only and are not to be construed as indicating or imposing a relative importance or implicitly indicating the number of technical features indicated. Thus, a feature that limited by "first", "second" may expressly or implicitly include at least one of the features. In the description of the present disclosure, the meaning of "plural" is two or more, unless otherwise specifically defined.

All of the terminologies containing one or more technical or scientific terminologies have the same meanings that persons skilled in the art understand ordinarily unless they are not defined otherwise. For example, "arrange," "couple," and "connect," should be understood generally in the embodiments of the present disclosure. For example, "firmly connect," "detachablely connect," and "integrally connect" are all possible. It is also possible that "mechanically connect," "electrically connect," and "mutually communicate" are used. It is also possible that "directly couple," "indirectly couple via a medium," and "two components mutually interact" are used.

All of the terminologies containing one or more technical or scientific terminologies have the same meanings that persons skilled in the art understand ordinarily unless they are not defined otherwise. For example, "upper" or "lower" of a first characteristic and a second characteristic may include a direct touch between the first and second characteristics. The first and second characteristics are not directly touched; instead, the first and second characteristics are touched via other characteristics between the first and second characteristics. Besides, the first characteristic arranged on/above/over the second characteristic implies that the first characteristic arranged right above/obliquely above or merely means that the level of the first characteristic is higher than the level of the second characteristic. The first characteristic arranged under/below/beneath the second characteristic implies that the first characteristic arranged right under/obliquely under or merely means that the level of the first characteristic is lower than the level of the second characteristic.

Different methods or examples are introduced to elaborate different structures in the embodiments of the present disclosure. To simplify the method, only specific components and devices are elaborated by the present disclosure. These embodiments are truly exemplary instead of limiting the present disclosure. Identical numbers and/or letters for reference are used repeatedly in different examples for simplification and clearance. It does not imply that the relations between the methods and/or arrangement. The methods proposed by the present disclosure provide a variety of examples with a variety of processes and materials. However, persons skilled in the art understand ordinarily that the application of other processes and/or the use of other kinds of materials are possible.

The present invention provides a GOA circuit and a display panel to alleviate the issue of ineffectively pulling down the gate driving signal in the conventional display panel.

Figure 2:
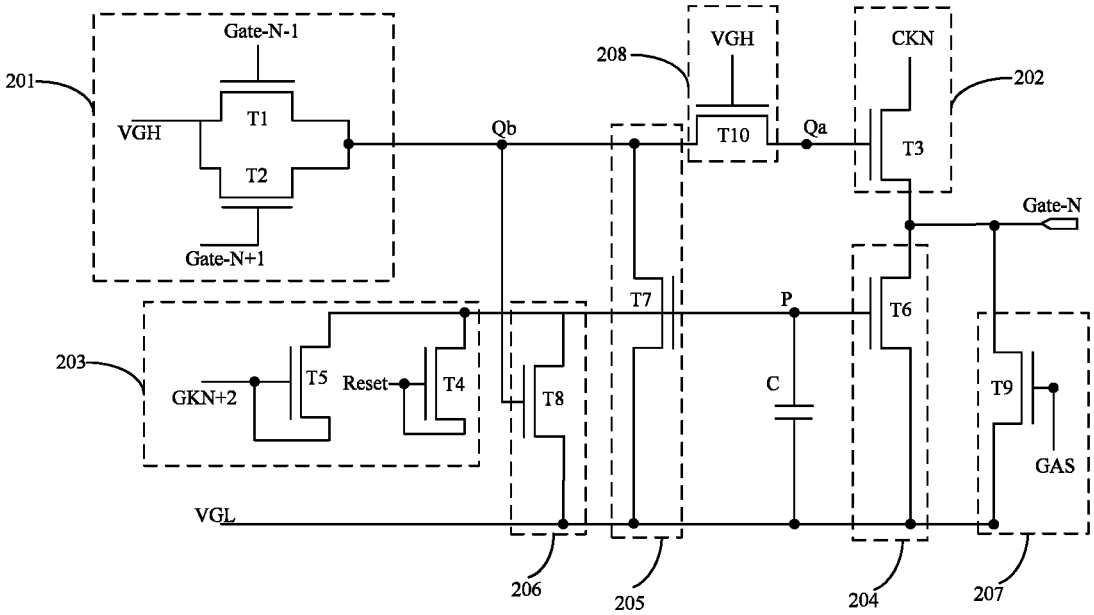
FIG. 2 is a diagram of a GOA circuit according to an embodiment of the present invention.

Please refer to FIG. 2. FIG. 2 is a diagram of a GOA circuit according to an embodiment of the present invention. As shown in FIG. 2, a GOA circuit is disclosed. The GOA circuit comprises m cascaded GOA units. The $n^{th}$-stage GOA unit comprises a scan control module 201, an output control module 202, a node control module 203, a first pull-down module 204, a second pull-down module 205, a third pull-down module 206 and a fourth pull-down module 207.

The scan control module 201 is configured to pull up the voltage level of the first node Qb according to the $(n-1)^{th}$-stage clock signal and the $(n+1)^{th}$-stage clock signal to control the GOA circuit to perform a scanning operation.

The output control module 202 is electrically connected to the scan control module 201 through the first node Qb. The output control module 202 is configured to output the high-voltage-level current-stage ($n^{th}$-stage) gate driving signal Gate_N according to the high-voltage-level current-stage clock signal CKN or output the low-voltage-level current-stage gate driving signal Gate_N according to the low-voltage-level current-stage clock signal CKN when the first node Qb corresponds to a high voltage level.

The node control module 203 is configured to pull up the voltage level of the second node P according to the reset signal Reset and the $(n+2)^{th}$-stage clock signal CHN+2.

The first pull-down module 204 is electrically connected to the node control module 203 through the second node P. The first pull-down module 204 is configured to pull down the voltage level of the current-stage gate driving signal Gate_N according to the low voltage signal VGL when the second node P corresponds to a high voltage level.

The second pull-down module 205 is electrically connected to the node control module 203 through the second node P. The second pull-down module 205 is configured to pull down the voltage level of the first node Qb according to the low voltage signal VGL when the second node P corresponds to a high voltage level.

The third pull-down module 206 is electrically connected to the scan control module 201 through the first node Qb. The third pull-down module 206 is configured to pull down the voltage level of the second node P according to the low voltage signal VGL when the first node P corresponds to a high voltage level.

The fourth pull-down module 207 is configured to control the GOA circuit to pull down the voltage level of the current-stage gate driving signal Gate_N according to the global signal GAS.

In the following disclosure, each module in the GOA circuit will be illustrated in details.

The scan control module comprises the first transistor T1 and the second transistor T2. The gate of the first transistor T1 is connected to the gate driving signal Gate_N−1 of the $(n-1)^{th}$-stage GOA unit. The gate of the second transistor T2 is connected to the gate driving signal Gate_N+1 of the $(n+1)^{th}$-stage GOA unit. The first electrode of the first transistor T1 and the first electrode of the second transistor T2 are connected to the high voltage signal VGH. The second electrode of the first transistor T1 and the second electrode of the second transistor T2 are connected to the first node Qb.

The output control module 202 comprises the third transistor T3. The first electrode of the third transistor T3 is connected to the current-stage clock signal CKN. The second electrode of the third transistor T3 is connected to the current-stage gate driving signal Gate_N.

The node control module 203 comprises the fourth transistor T4 and the fifth transistor T5. The gate and the first electrode of the fourth transistor T4 are connected to the reset signal Reset. The gate and the first electrode of the fifth transistor T5 are connected to the $(n+2)^{th}$-stage clock signal CKN+2. The second electrode of the fourth transistor T4 and the second electrode of the fifth transistor T5 are connected to the second node P.

The first pull-down module 204 comprises the sixth transistor T6. The gate of the sixth transistor T6 is connected to the second node P. The first electrode of the sixth transistor T6 is connected to the low voltage signal VGL. The second electrode of the sixth transistor T6 is connected to the current-stage gate driving signal Gate_N.

The second pull-down module 205 comprises the seventh transistor T7. The gate of the seventh transistor T7 is connected to the second node P. The first electrode of the seventh transistor T7 is connected to the low voltage signal VGL. The second electrode of the seventh transistor T7 is connected to the first node Qb.

The third pull-down module 206 comprises the eighth transistor T8. The gate of the eighth transistor T8 is connected to the first node Qb. The first electrode of the eighth transistor T8 is connected to the low voltage signal VGL. The second electrode of the eighth transistor T8 is connected to the second node P.

The fourth pull-down module 207 comprises the ninth transistor T9. The gate of the ninth transistor T9 is connected to the global signal GAS. The first electrode of the ninth transistor T9 is connected to the low voltage signal VGL. The second electrode of the ninth transistor T9 is connected to the current-stage gate driving signal Gate_N.

The $n^{th}$-stage GOA unit further comprises a regulating module 208. The regulating module 208 comprises the tenth transistor T10. The gate of the tenth transistor T10 is connected to the high voltage signal VGH. The first electrode of the tenth transistor T10 is connected to the first node Qb. The second electrode of the tenth transistor T10 is connected to the gate of the third transistor T3 through the third node Qa.

The $n^{th}$-stage GOA unit further comprises a capacitor C. The first electrode plate of the capacitor C is connected to the second node P. The second electrode plate of the capacitor C is connected to the low voltage signal VGL.

Figure 3:
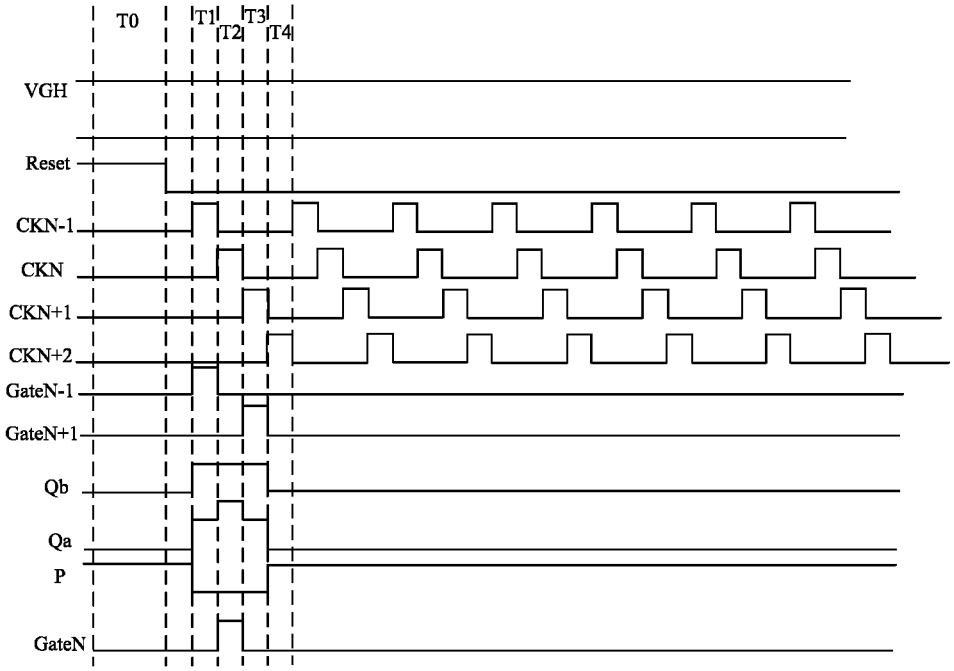
FIG. 3 is a timing diagram of signals in the GOA circuit according to an embodiment of the present invention.

In the following disclosure, the operation of the GOA circuit will be illustrated with FIG. 3.

The operation of the GOA circuit has a reset state and a working state. In FIG. 3, the reset state is T0. The working state has the first working state T1, the second working state T2, the third working state T3 and the fourth working state t4.

In the T0 state, the reset signal Reset of node control module 203 corresponds to the high voltage level, the fourth transistor T4 is turned on to pull up the voltage level of the second node P. Therefore, the sixth transistor T6 of the first pull-down module 204 and the seventh transistor T7 of the second pull-down module are both turned on to pull down the voltage level of the first node Qb and the third node Qa. The initial voltage level of the current-stage gate driving signal Gate_N is a low voltage level.

After a period of time after the T0 state, the working state is entered.

In the first working state T1, the gate driving signal Gate_N−1 of the $(n-1)^{th}$-stage GOA unit corresponds to a high voltage level such that the first transistor T1 of the scan control module 201 is turned on. At this time, the third transistor T3 of the output control module 202 is turned on and the eighth transistor T8 of the third pull-down module 206 is turned on to transfer the low voltage signal VGL to the second node P such that the voltage level of the second node P is a low voltage level. Furthermore, the sixth transistor T6 of the first pull-down module 204 and the seventh transistor T7 of the second pull-down module 205 are turned off.

In the second working state T2, the gate driving signal Gate_N−1 of the $(n-1)^{th}$-stage GOA unit becomes a low voltage level. The first transistor T1 of the scan control module 201 is turned off. Because there is no capacitor placed between the scan control module 201 and the output control module 202, there is no current leakage path. Thus, the first node Qb and the third node Qa could still maintain their high voltage level. At this time, the current-stage clock signal CKN corresponds to a high voltage level and the current-stage gate driving signal Gate_N corresponds to a high voltage level.

In the third working state T3, because the $(n+2)^{th}$-stage clock signal CKN+2 has not entered yet, the first node Qb and the third node Qa still remain corresponding to a high voltage level. At this time, the current-stage clock signal CKN becomes a low voltage level and the third transistor T3 remains on. Thus, the current-stage clock signal CKN instantly pulls down the current-stage gate driving signal Gate_N to a low voltage level.

In the fourth working state T4, the gate driving signal Gate_N+1 of the $(n+1)^{th}$-stage GOA unit corresponds to a low voltage level, the second transistor T2 of the scan control module 201 is turned off and the $(n+2)^{th}$-stage clock signal CKN+2 corresponds to a high voltage level. In this way, the voltage level of the second node P is pulled up and the seventh transistor T7 is turned on to pull down the voltage levels of the first node Qb and the third node Qa. Furthermore, the capacitor C is charged. The sixth transistor T6 and the seventh transistor T7 are continuously turned on. The low voltage signal VGL continuously pulls down the first node Qb, the third node Qa and the current-stage gate driving signal. This could help alleviate other signals' pulling up the current-stage gate driving signal Gate_N and also reduces the noises.

In this embodiment, there is no capacitor placed at the node Qb. Therefore, when the first node Qb and the current-stage clock signal CKN correspond to a low voltage level, the voltage level of the current-stage driving signal Gate_N could quickly be pulled down and thus the fall time of the current-stage driving signal Gate_N is reduced and the interference is alleviated. After the current-stage driving signal Gate_N changes from a high voltage level to a low voltage level, the node control module 203 pulls up the voltage level of the second node P. Therefore, the first pull-down module 204 and the second pull-down module 205 could work together to pull down the current-stage driving signal Gate_N and the first node Qb through the low voltage signal VGL. This could help alleviate other signals' pulling up the current-stage gate driving signal Gate_N and also reduces the noises. Also, the risk of incorrect output is reduced. Therefore, the GOA circuit according to an embodiment of the present invention raises the pull-down effect on the current-stage gate driving signal Gate_N.

In contrast to the conventional art, the GOA circuit according to an embodiment of the present invention only needs to include ten transistors and a capacitor through optimizing the structure and stage signals. In this way, it could save some spaces in the film layer pattern. Furthermore, because the fall time of the current-stage gate driving signal is reduced, the time for turning on the multi-channel multiplexer MUX could be reduced and the stability of the stage output could be raised.

Figure 4:
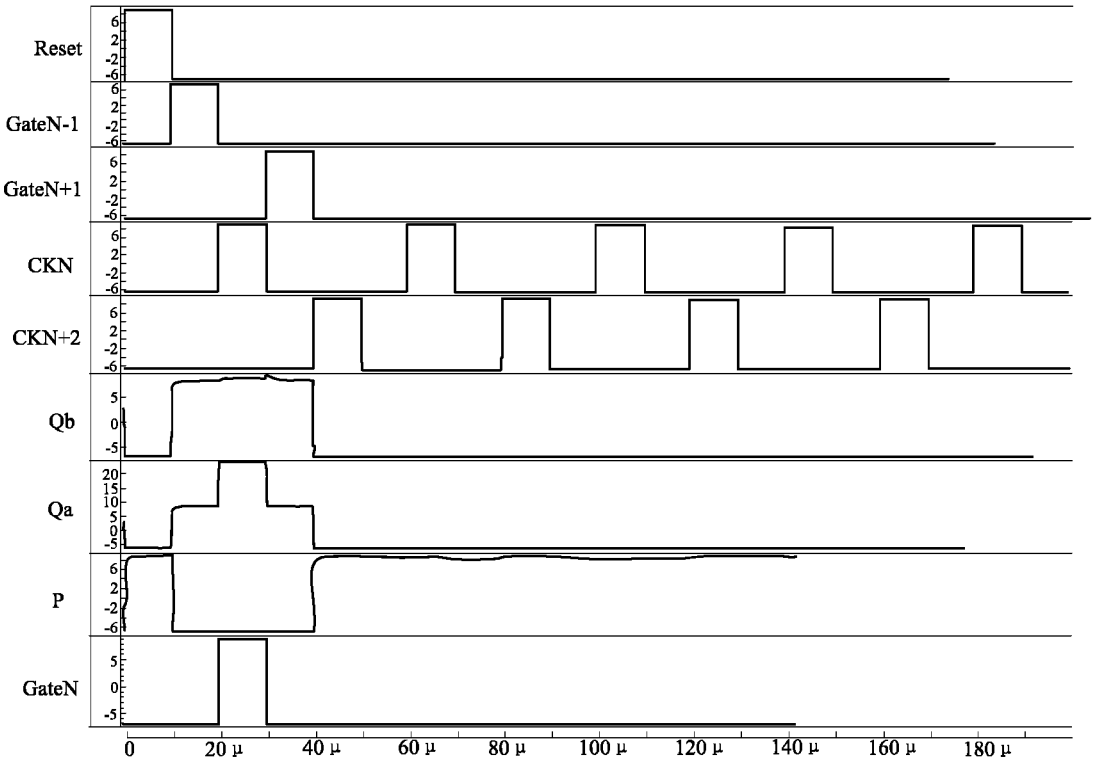
FIG. 4 is a diagram depicting a simulation result of signals in the GOA circuit according to an embodiment of the present invention.

Please refer to FIG. 4. FIG. 4 is a diagram depicting a simulation result of signals shown in FIG. 3. Here, the x-axis represents the time (micro-second), and the y-axis represents the voltage level (Volts). From FIG. 3 and FIG. 4, it could be seen that the simulation result and the prediction result are basically consistent, which means that the GOA circuit according to an embodiment of the present invention could definitely raise the effect of pulling down the signals.

In an embodiment, if there is no need to support both forward scan and the backward scan, the scan control module 201 could comprise only one transistor. That is, the scan control module 201 could comprise only the first transistor T1 for forward scan or only the second transistor T2 for backward scan.

In this embodiment, each of the transistors could be an N-type transistor. This is an example, not a limitation of the present invention. When each of the transistors is a P-type transistor, the timing diagram could be correspondingly adjusted from high to low or from low to high. In this way, the effect of pulling down the signals could still be raised.

Furthermore, a display panel is disclosed according to an embodiment of the present invention. The display panel comprises the GOA circuit of any one of the above embodiments. The display panel comprises a plurality of sub-pixels arranged in a matrix. The GOA circuit comprises m cascaded GOA units, where each GOA unit is used to control a line of sub-pixels of the display panel for displaying an image. In addition, the display panel also has an electrostatic discharge circuit, which surrounds the display panel at its edge area.

According to an embodiment of the present invention, a display panel is disclosed. The display panel comprises a GOA circuit. The GOA circuit comprises m cascaded GOA units. The $n^{th}$-stage GOA unit comprises: a scan control module, configured to pull up a voltage level of a first node according to a $(n-1)^{th}$-stage clock signal and a $(n+1)^{th}$-stage clock signal to control the GOA circuit to perform a scanning operation; an output control module, electrically connected to the scan control module through the first node, configured to output a high-voltage-level current-stage gate driving signal according to a high-voltage-level current-stage clock signal or output a low-voltage-level current-stage gate driving signal according to a low-voltage-level current-stage clock signal when the first node corresponds to a high voltage level; a node control module, configured to pull up a voltage level of a second node according to a reset signal and a $(n+2)^{th}$-stage clock signal; a first pull-down module, electrically connected to the node control module through the second node, configured to pull down a voltage level of a current-stage gate driving signal according to a low voltage signal when the second node corresponds to a high voltage level; a second pull-down module, electrically connected to the node control module through the second node, configured to pull down a voltage level of the first node according to the low voltage signal when the second node corresponds to a high voltage level; a third pull-down module, electrically connected to the scan control module through the first node, configured to pull down a voltage level of the second node according to the low voltage signal when the first node corresponds to a high voltage level; and a fourth pull-down module, configured to control the GOA circuit to pull down the voltage level of the current-stage gate driving signal according to the global signal.

In one embodiment of the present invention, the scan control module comprises: a first transistor, having a gate connected to a gate driving signal of a $(n-1)^{th}$-stage GOA unit, a first electrode connected to a high voltage signal, and a second electrode connected to the first node; and a second transistor, having a gate connected to a gate driving signal of a $(n+1)^{th}$-stage GOA unit, a first electrode connected to the high voltage signal, and a second electrode connected to the first node.

In one embodiment of the present invention, the output control module comprises: a third transistor, having a first electrode connected to the current-stage clock signal and a second electrode connected to the current-stage gate driving signal.

In one embodiment of the present invention, the node control module comprises: a fourth transistor, having a gate connected to the reset signal, a first electrode connected to the gate of the fourth transistor, and a second electrode; and a fifth transistor, having a gate connected to the $(n+2)^{th}$-stage clock signal, a first electrode connected to the gate of the fifth transistor, and a second electrode connected to the second node and the second electrode of the fourth transistor.

In one embodiment of the present invention, the first pull-down module comprises: a sixth transistor, having a gate connected to the second node, a first electrode connected to the low voltage signal, and a second electrode connected to the current-stage gate driving signal.

In one embodiment of the present invention, the second pull-down module comprises: a seventh transistor, having a gate connected to the second node, a first electrode connected to the low voltage signal, and a second electrode connected to the first node.

In one embodiment of the present invention, the third pull-down module comprises: an eighth transistor, having a gate connected to the first node, a first electrode connected to the low voltage signal, a second electrode connected to the second node.

In one embodiment of the present invention, the fourth pull-down module comprises: a ninth transistor, having a gate connected to the global signal, a first electrode connected to the low voltage signal, and a second electrode connected to the current-stage gate driving signal.

In one embodiment of the present invention, the $n^{th}$-stage GOA unit further comprises: a regulating module, comprising: a tenth transistor, having a gate connected to the high voltage signal, a first electrode connected to the first node, and a second electrode connected to the gate of the third transistor through a third node.

In one embodiment of the present invention, the $n^{th}$-stage GOA unit further comprises: a capacitor, having a first electrode plate connected to the second node, and a second electrode plate connected to the low voltage signal.

In the display panel of the present disclosure, the present invention does not place a capacitor at the first node. Therefore, when the first node and the current-stage clock signal both correspond to a low voltage level, the voltage level of the current-stage gate driving signal could be quickly pulled down such that the fall time of the current-stage gate driving signal is reduced and the interference is alleviated. After the voltage level of the current-stage gate driving signal is changed from the high voltage level to the low voltage level, the node control module pulls up the voltage level of the second node. In this way, the first pull-down module and the second pull-down module work together to pull down the current-stage gate driving signal through the low voltage signal. This could help alleviate other signals' pulling up the current-stage gate driving signal and thus reduces the noises. Therefore, the GOA circuit of an embodiment of the present invention raises the effect of pulling down the current-stage gate driving signal.

The present invention provides a GOA circuit and a display panel. The GOA circuit comprises m cascaded GOA units. The $n^{th}$-stage GOA unit comprises: a scan control module, configured to pull up a voltage level of a first node according to a $(n-1)^{th}$-stage clock signal and a $(n+1)^{th}$-stage clock signal to control the GOA circuit to perform a scanning operation; an output control module, electrically connected to the scan control module through the first node, configured to output a high-voltage-level current-stage gate driving signal according to a high-voltage-level current-stage clock signal or output a low-voltage-level current-stage gate driving signal according to a low-voltage-level current-stage clock signal when the first node corresponds to a high voltage level; a node control module, configured to pull up a voltage level of a second node according to a reset signal and a $(n+2)^{th}$-stage clock signal; a first pull-down module, electrically connected to the node control module through the second node, configured to pull down a voltage level of a current-stage gate driving signal according to a low voltage signal when the second node corresponds to a high voltage level; a second pull-down module, electrically connected to the node control module through the second node, configured to pull down a voltage level of the first node according to the low voltage signal when the second node corresponds to a high voltage level; a third pull-down module, electrically connected to the scan control module through the first node, configured to pull down a voltage level of the second node according to the low voltage signal when the first node corresponds to a high voltage level; and a fourth pull-down module, configured to control the GOA circuit to pull down the voltage level of the current-stage gate driving signal according to the global signal. The present invention does not place a capacitor at the first node. Therefore, when the first node and the current-stage clock signal both correspond to a low voltage level, the voltage level of the current-stage gate driving signal could be quickly pulled down such that the fall time of the current-stage gate driving signal is reduced and the interference is alleviated. After the voltage level of the current-stage gate driving signal is changed from the high voltage level to the low voltage level, the node control module pulls up the voltage level of the second node. In this way, the first pull-down module and the second pull-down module work together to pull down the current-stage gate driving signal through the low voltage signal. This could help alleviate other signals' pulling up the current-stage gate driving signal and thus reduces the noises. Therefore, the GOA circuit of an embodiment of the present invention raises the effect of pulling down the current-stage gate driving signal.

When discussing each embodiment above, it might focus on different parts. A person having ordinary skills in the art could refer to another embodiment if the embodiment under discussion is not illustrated in details.

Above are embodiments of the present invention, which does not limit the scope of the present invention. Any modifications, equivalent replacements or improvements within the spirit and principles of the embodiment described above should be covered by the protected scope of the invention.

What is claimed is:

1. A gate driver on array (GOA) circuit, comprising m cascaded GOA units, wherein an nth-stage GOA unit comprises:

a scan control module, configured to pull up a voltage level of a first node according to a (n−1)th-stage clock signal and a (n+1)th-stage clock signal to control the GOA circuit to perform a scanning operation;

an output control module, electrically connected to the scan control module through the first node, configured to output a high-voltage-level current-stage gate driving signal according to a high-voltage-level current-stage clock signal or output a low-voltage-level current-stage gate driving signal according to a low-voltage-level current-stage clock signal When the first node corresponds to a high voltage level;

a node control module, configured to pull up a voltage level of a second node according to a reset signal and a (n+2)th-stage clock signal;

a first pull-clown module, electrically connected to the node control module through the second node, configured to pull down a voltage level of a current-stage gate driving signal according to a low voltage signal when the second node corresponds to a high voltage level;

a second pull-down module, electrically connected to the node control module through the second node, configured to pull down a voltage level of the first node according to the low voltage signal when the second node corresponds to a high voltage level;

a third pull-down module, electrically connected to the scan control module through the first node, configured to pull down a voltage level of the second node according to the low voltage signal when the first node corresponds to a high voltage level; and a fourth pull-down module, configured to control the GOA circuit to pull down the voltage level of the current-stage gate driving signal according to the global signal, wherein the scan control module comprises:

a first transistor, having a gate connected to a gate driving signal of a (n−1)th-stage GOA unit, a first electrode connected to a high voltage signal, and a second electrode connected to the first node; and a second transistor, having a gate connected to a gate driving signal of a (n+1)th-stage GOA unit, a first electrode connected to the high voltage signal, and a second electrode connected to the first node, wherein the output control module comprises:

a third transistor, having a first electrode connected to the current-stage clock signal and a second electrode connected to the current-stage gate driving signal, wherein the node control module comprises:

a fourth transistor, having a gate connected to the reset signal, a first electrode connected to the gate of the fourth transistor, and a second electrode; and a fifth transistor, having a gate connected to the (n+2)th-stage clock signal, a first electrode connected to the gate of the fifth transistor, and a second electrode connected to the second node and the second electrode of the fourth transistor.

2. The GOA circuit of claim 1, wherein the first pull-down module comprises:

a sixth transistor, having a gate connected to the second node, a first electrode connected to the low voltage signal, and a second electrode connected to the current stage gate driving signal.

3. The GOA circuit of claim 2, wherein the second pull-down module comprises:

a seventh transistor, having a gate connected to the second node, a first electrode connected to the low voltage signal, and a second electrode connected to the first node.

4. The GOA circuit of claim 3, wherein the third pull-down module comprises:

an eighth transistor, having a gate connected to the first node, a first electrode connected to the low voltage signal, a second electrode connected to the second node.

5. The GOA circuit of claim 4, wherein the fourth pull-down module comprises:

a ninth transistor, having a gate connected to the global signal, a first electrode connected to the low voltage signal, and a second electrode connected to the current-stage gate driving signal.

6. The GOA circuit of claim 4, wherein the nth-stage GOA unit further comprises:

a regulating module, comprising:

a tenth transistor, having a gate connected to the high voltage signal, a first electrode connected to the first node, and a second electrode connected to the gate of the third transistor through a third node.

7. The GOA circuit of claim 1, wherein the nth-stage GOA unit further comprises:

a capacitor, having a first electrode plate connected to the second node, and a second electrode plate connected to the low voltage signal.

8. A display panel comprising a gate driver on array (GOA) circuit, the GOA circuit comprising in cascaded GOA units. wherein an nth-stage GOA unit comprises:

a scan control module, configured to pull up a voltage level of a first node according to a (n−1)th-stage clock signal and a (n+1)th-stage clock signal to control the GOA circuit to perform a scanning operation;

an output control module, electrically connected to the scan control module through the first node, configured to output a high-voltage-level current-stage gate driving signal according to a high-voltage-level current-stage clock signal or output a low-voltage-level current-stage gate driving signal according to a low-voltage-level current-stage clock signal when the first node corresponds to a high voltage level;

a node control module, configured to pull up a voltage level of a second node according to a reset signal and a (n+2)th-stage clock signal;

a first pull-down module, electrically connected to the node control module through the second node, configured to pull down a voltage level of a current-stage gate driving signal according to a low voltage signal when the second node corresponds to a high voltage level;

a second pull-down module, electrically connected to the node control module through the second node, configured to pull down a voltage level of the first node according to the low voltage signal when the second node corresponds to a high voltage level;

a third pull-down module, electrically connected to the scan control module through the first node, configured to pull down a voltage level of the second node according to the low voltage signal when the first node corresponds to a high voltage level; and a fourth pull-down module, configured to control the GOA circuit to pull down the voltage level of the current-stage gate driving signal according to the global signal, wherein the scan control module comprises:

a first transistor, having a gate connected to a gate driving signal of a (n−1)th-stage GOA unit, a first electrode connected to a high voltage signal, and a second electrode connected to the first node; and a second transistor, having a gate connected to a gate driving signal of a (n+1)th-stage GOA unit, a first electrode connected to the high voltage signal, and a second electrode connected to the first node, wherein the output control module comprises:

a third transistor, having a first electrode connected to the current-stage clock signal and a second electrode connected to the current-stage gate driving signal, wherein the node control module comprises:

a fourth transistor, having a gate connected to the reset signal, a first electrode connected to the gate of the fourth transistor, and a second electrode; and a fifth transistor, having a gate connected to the (n+2)th-stage clock signal, a first electrode connected to the gate of the fifth transistor, and a second electrode connected to the second node and the second electrode of the fourth transistor.

9. The display panel of claim 8, wherein the first pull-down module comprises:

a sixth transistor, having a gate connected to the second node, a first electrode connected to the low voltage signal, and a second electrode connected to the current-stage gate driving signal.

10. The display panel of claim 9, wherein the second pull-down nodule comprises:

a seventh transistor, having a gate connected to the second node, a first electrode connected to the low voltage signal, and a second electrode connected to the first node.

11. The display panel of claim 10, wherein the third pull-down module comprises:

an eighth transistor, having a gate connected to the first node, a first electrode connected to the low voltage signal, a second electrode connected to the second node.

12. The display panel of claim 11, wherein the fourth pull-down module comprises:

a ninth transistor, having a gate connected to the global signal, a first electrode connected to the low voltage signal, and a second electrode connected to the current-stage gate driving signal.

13. The display panel of claim 11, wherein the nth-stage GOA unit further comprises:

a regulating module, comprising:

a tenth transistor, having a gate connected to the high voltage signal, a first electrode connected to the first node, and a second electrode connected to the gate of the third transistor through a third node.

14. The display panel of claim 8, wherein the nth-stage GOA unit further comprises:

a capacitor, having a first electrode plate connected to the second node, and a second electrode plate connected to the low voltage signal.

* * * * *